US006332495B1

(12) United States Patent
Jamison et al.

(10) Patent No.: US 6,332,495 B1
(45) Date of Patent: Dec. 25, 2001

(54) CLIP ON MANIFOLD HEAT EXCHANGER

(75) Inventors: S. Donald Jamison, Waterloo; Carl C. J. Decaire, Cambridge; Jeffrey D. Peeler, York; Chad A. Kreutzweiser, Kitchener, all of (CA)

(73) Assignee: Long Manufacturing Ltd., Oakville (CA)

( * ) Notice: Subject to any disclaimer, the term of this patent is extended or adjusted under 35 U.S.C. 154(b) by 0 days.

(21) Appl. No.: 09/685,818

(22) Filed: Oct. 10, 2000

Related U.S. Application Data

(63) Continuation-in-part of application No. 09/411,295, filed on Oct. 4, 1999.

(30) Foreign Application Priority Data

Jun. 2, 1999 (CA) ..... 2273456

(51) Int. Cl.[7] ..... F28F 9/04

(52) U.S. Cl. ..... 165/153; 165/148; 165/149; 165/67; 165/173; 165/174

(58) Field of Search ..... 165/148, 153, 165/149, 173, 174, 175; 29/890.052

(56) References Cited

U.S. PATENT DOCUMENTS

| | | | | |
|---|---|---|---|---|
| 1,420,917 | * | 6/1922 | Elliott | 165/148 |
| 2,182,338 | * | 12/1939 | Gurlik | 165/152 |
| 3,016,230 | | 1/1962 | Cederstrom et al. . | |
| 3,265,126 | | 8/1966 | Donaldson | 165/140 |
| 3,472,316 | | 10/1969 | Couch, Jr. | 165/153 |
| 3,757,855 | | 9/1973 | Kun et al. | 165/166 |
| 4,313,494 | * | 2/1982 | Bengtsson | 165/148 |
| 5,062,476 | | 11/1991 | Ryan et al. | 165/173 |
| 5,186,250 | * | 2/1993 | Ouchi et al. | 165/177 |
| 5,236,042 | | 8/1993 | Kado | 165/149 |
| 5,501,271 | | 3/1996 | Wijkstrom | 165/173 |
| 5,667,004 | | 9/1997 | Kroetsch | 165/41 |
| 6,012,512 | * | 1/2000 | Ghiani | 165/140 |
| 6,068,050 | * | 5/2000 | Ghiani | 165/174 |

* cited by examiner

*Primary Examiner*—Allen Flanigan
(74) *Attorney, Agent, or Firm*—Ridout & Maybee LLP

(57) ABSTRACT

A plate and fin type heat exchanger is disclosed which can be made in any convenient size with minimum tooling required. The heat exchanger is made from a plurality of stacked plate pairs having raised peripheral edge portions to define flow channels inside the plate pairs. The plates of the plate pairs are formed with offset, diverging end flanges that space the plate pairs apart. A U-shaped channel envelops the plate end flanges to form part of a manifold at each end of the plate pairs. End caps or plates close the open ends of the U-shaped channels to complete the manifolds, and inlet and outlet openings are formed in the manifolds as desired to complete the heat exchanger.

22 Claims, 9 Drawing Sheets

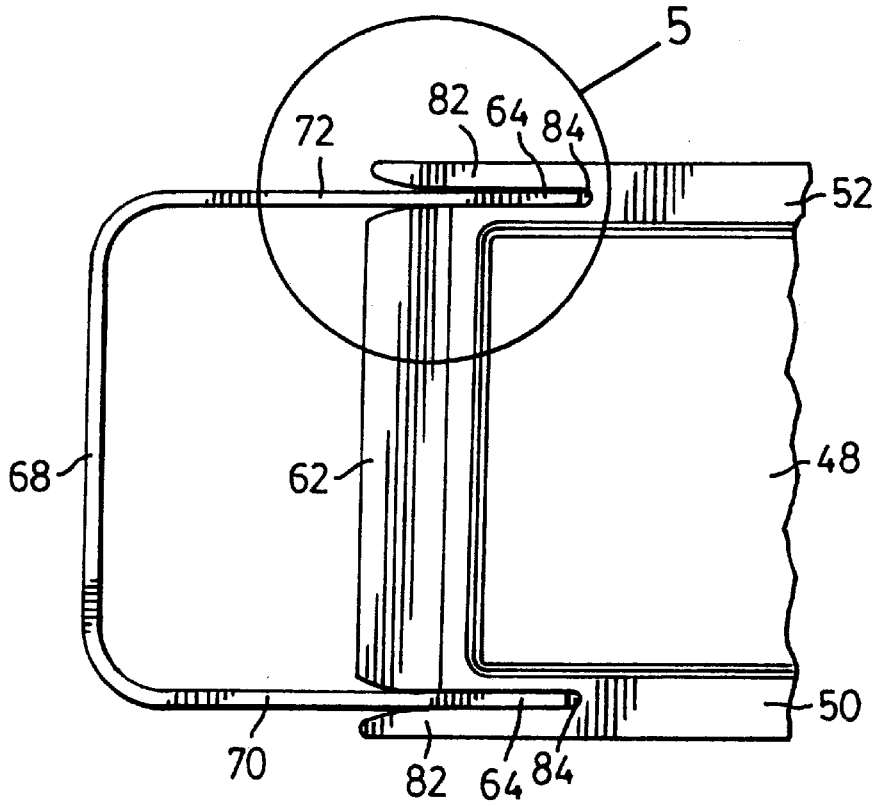
FIG. 4
FIG. 5
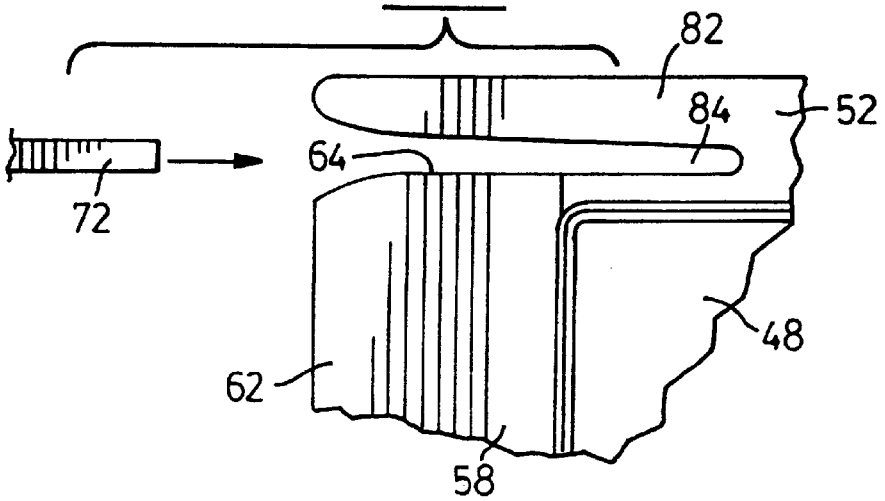

CLIP ON MANIFOLD HEAT EXCHANGER

CROSS REFERENCE TO RELATED APPLICATIONS

This is a continuation-in-part application of U.S. patent application Ser. No. 09/411,295 filed Oct. 4, 1999.

BACKGROUND OF THE INVENTION

This invention relates to heat exchangers, and in particular, to plate and fin type heat exchangers such as the type used with internal combustion engines for cooling engine coolant.

In the past, engine coolant heat exchangers, such as radiators, have been made by providing a plurality of parallel, spaced-apart flat tubes with cooling fins located therebetween to form a core. Opposed ends of the tubes pass through openings formed in manifolds or headers located on each side of the core at the respective ends of the tubes. A difficulty with this type of construction is that the tube to headerjoints are difficult to fabricate and prone to leakage.

A method of overcoming these difficulties is shown in U.S. Pat. No. 3,265,126 issued to D. M. Donaldson. In this patent, headers are provided with a continuous longitudinal opening, and the tubes are formed with specially shaped ends to fit into this continuous opening, thus simplifying the assembly and reducing the leakage problem. A difficulty with the Donaldson structure, however, is that the shape of the various components is quite complex resulting in high tooling costs.

The present invention is a heat exchanger of universal application where relatively simple and inexpensive tooling is required to make heat exchangers of different types and even with differing sizes and configurations.

SUMMARY OF THE INVENTION

According to one aspect of the invention, there is provided a heat exchanger comprising a plurality of stacked plate pairs formed of mating plates having central planar portions and raised peripheral edge portions. The edge portions are joined together in mating plates to define a flow channel between the plates. The plates have offset end flanges, the respective flanges at each end of each plate pair diverging. The flanges have lateral edge portions extending from root areas located at the joined peripheral edge portions. The end flanges also have transverse distal edge portions joined together in back-to-back stacked plate pairs to space the plate pairs apart and form transverse flow passages between the plate pairs. Opposed U-shaped channels enclose the respective end flanges of the plate pairs. The channels have rear walls spaced from the plate end flanges and side walls joined to the flange lateral edge portions covering the root areas. The U-shaped channels have open ends. End plates close the U-shaped channel open ends to form manifolds. Also, the manifolds define inlet and outlet openings therein for the flow of fluid through the plate pairs.

According to another aspect of the invention, there is provided a method of making a heat exchanger comprising the steps of providing an elongate strip of plate material having a planar central portion and raised peripheral edge portions. The plate material is cut into predetermined lengths. The plate lengths are formed with offset end flanges extending in a direction away from the peripheral edge portions. The plate lengths are arranged into plate pairs with the offset end flanges diverging and the plate peripheral edge portions in contact. The plate pairs are stacked so that the end flanges engage to space the plate pairs apart. U-shaped channels are provided to enclose the plate offset end flanges, the channels having open ends. The channel open ends are closed to form manifolds, and inlet and outlet openings are formed in the manifolds. The plates and manifolds are joined together to form a sealed heat exchanger.

BRIEF DESCRIPTION OF THE DRAWINGS

Preferred embodiments of the invention will now be described, by way of example, with reference to the accompanying drawings, in which:

FIG. 4 is a plan view taken along lines 4—4 of FIG. 3;

FIG. 5 is an enlarged scrap view of the area of FIG. 4 indicated by circle 5;

DESCRIPTION OF THE PREFERRED EMBODIMENT

Figure 1:
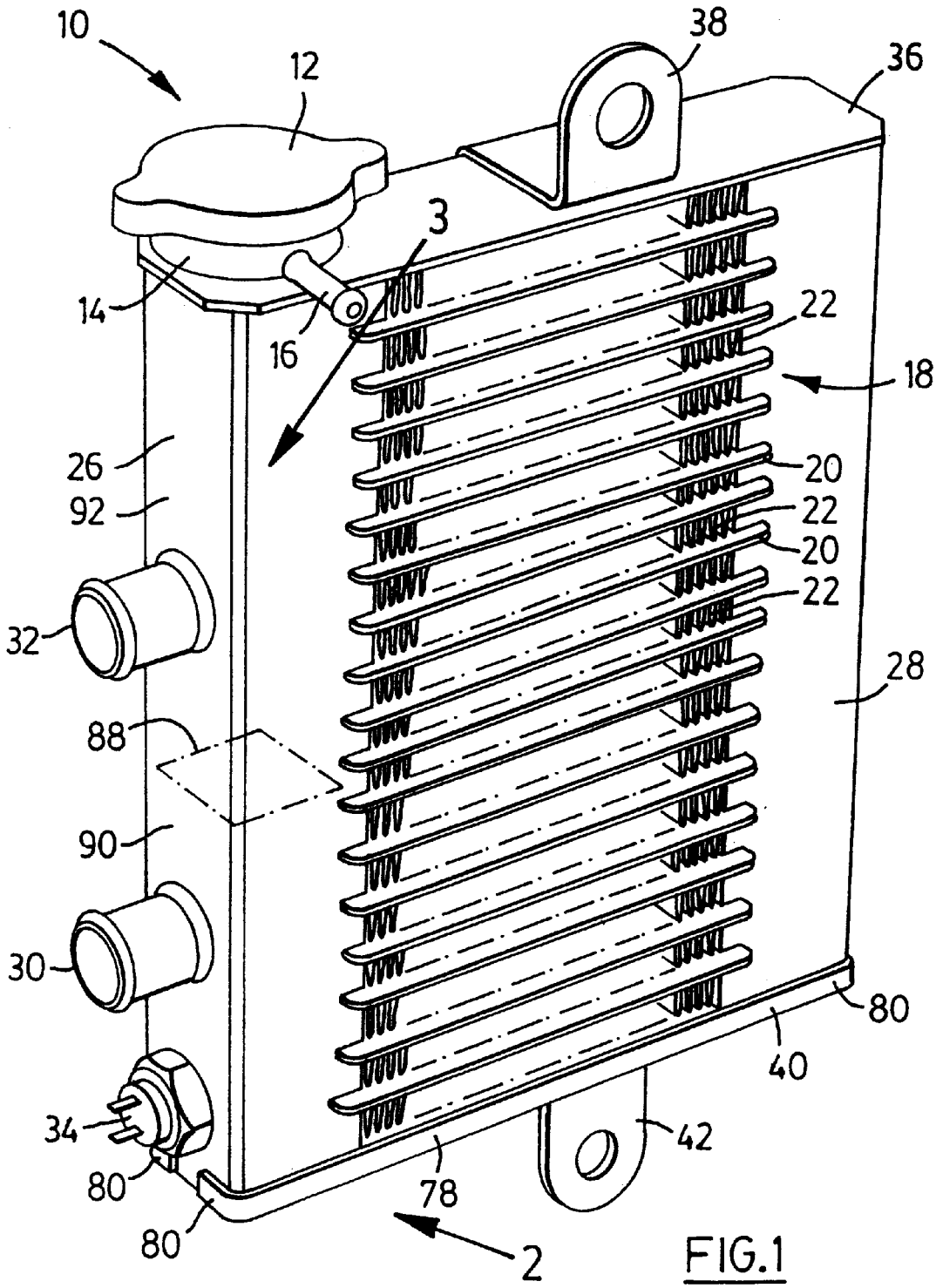
FIG. 1 is a top, left perspective view of a preferred embodiment of a heat exchanger made in accordance with the present invention.

Referring firstly to FIG. 1, a preferred embodiment of a heat exchanger according to the present invention is generally indicated by reference numeral 10. Heat exchanger 10 is in the form of a radiator for cooling the coolant of an internal combustion engine, such as is typically found in an automotive vehicle. Heat exchanger 10 includes a filler cap 12 mounted in a suitable fitting 14 having an overflow or pressure relief outlet 16. Heat exchanger 10 has a core 18 formed of a plurality of spaced-apart plate pairs 20 with cooling fins 22 located therebetween. Cooling fins 22 are the usual type of corrugated cooling fins having transverse undulations or louvres 24 formed therein to increase heat transfer (see FIGS. 3 and 8). Any type of cooling fin could be used in the present invention, or even no cooling fin at all, if desired.

Heat exchanger 10 has a pair of manifolds 26, 28 located at the respective ends of plate pairs 20. Inlet and outlet nipples or fittings 30, 32 are mounted in one of the manifolds 26, 28 for the flow of coolant into and out of heat exchanger 10, as will be described further below. An optional temperature sensor 34 can also be mounted in one of the manifolds 26, 28 to sense the temperature of the coolant inside heat exchanger 10.

A top end plate 36 closes the upper ends of manifolds 26, 28 and provides a location for mounting the filler cap fitting 14 and also a bracket 38 for mounting heat exchanger 10 in a desired located. A bottom end plate 40 is also provided to close the lower ends of manifolds 26, 28 and provide a location for the attachment of another mounting bracket 42 for mounting heat exchanger 10 in a desired location. If desired, filler cap 12 could be mounted in or attached to the walls of either manifold 26 or 28 instead of end plate 36.

Figure 3:
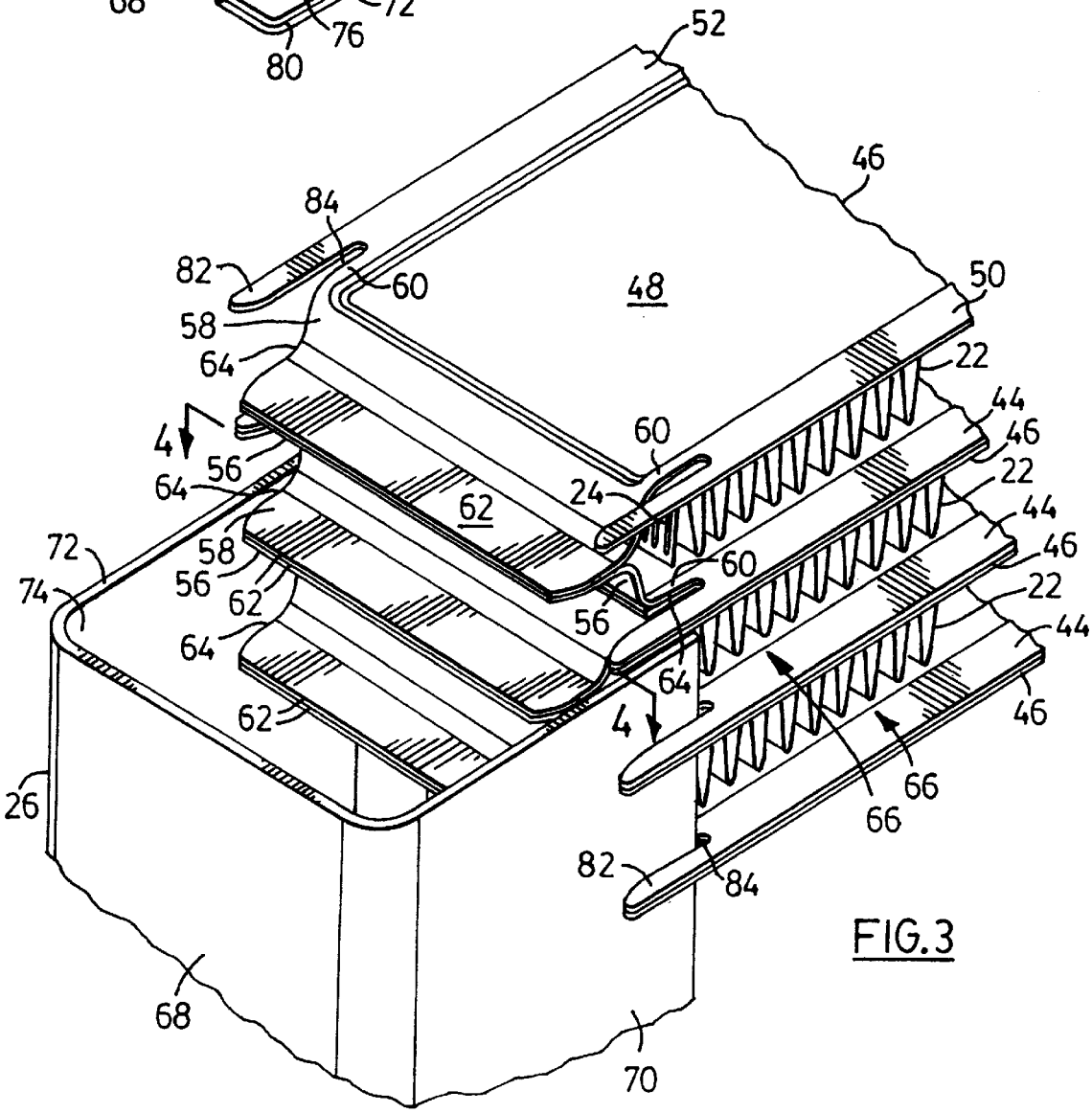
FIG. 3 is an enlarged perspective view taken in the direction of arrow 3 of FIG. 1 showing a portion of the heat exchanger of FIG. 1 being assembled.
Figure 8:
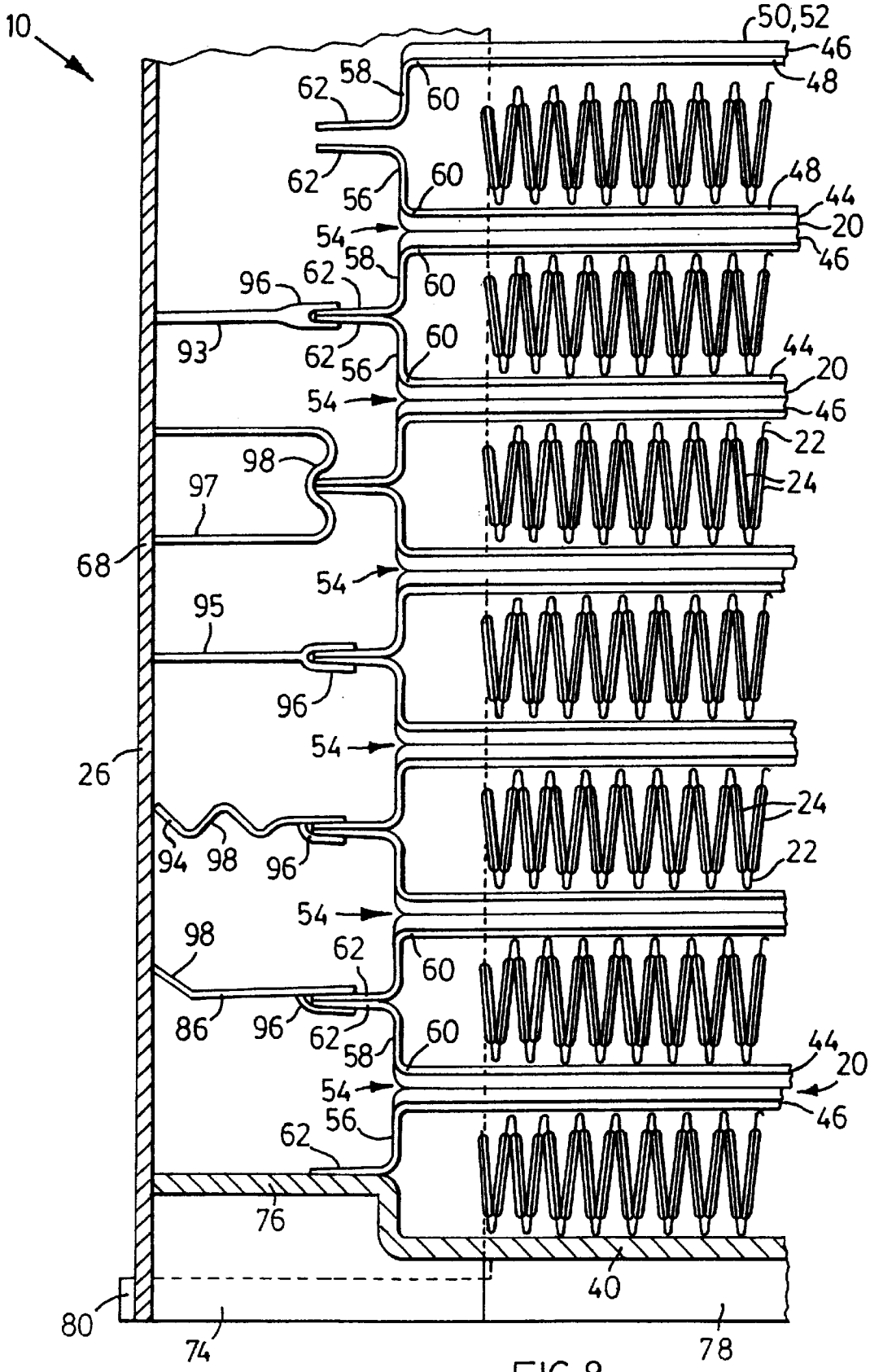
FIG. 8 is a vertical sectional view taken along lines 8—8 of FIG. 6 showing various types of baffles that could be used in the manifolds of the present invention.

Referring next to FIGS. 3 and 8, plate pairs 20 are formed of top and bottom mating plates 44, 46. Each plate 44, 46 has a central planar portion 48 and raised peripheral edge portions 50, 52, so that when the plates 44, 46 are put together face-to-face, the peripheral edge portions 50, 52 are joined together and the planar central portions 48 are spaced apart to define a flow channel 54 (see FIG. 8) between the plates.

As seen best in FIGS. 3 and 8, plates 44, 46 have offset end flanges 56, 58. The respective end flanges 56, 58 at each end of each plate pair 20 diverge from a root area 60 where the raised peripheral edge portions 50, 52 are still joined together, to transverse distal edge portions or flange extensions 62. The offset end flanges 58 also have lateral edge portions 64 that extend from root areas 60 to transverse distal edge portions 62. It will be noted that transverse distal edge portions or flange extensions 62 are joined together in back-to-back stacked plate pairs 20. This spaces the plate pairs 20 apart to provide transverse flow passages 66 between the plate pairs where cooling fins 22 are located.

Manifolds 26, 28 are formed of opposed, U-shaped channels having rear walls spaced from the plate offset end flanges 56, 58, and side walls 70, 72 joined to the flange lateral edge portions 64. The channel side walls 70, 72 actually cover the root areas 60 where the peripheral flanges 50,52 are still joined together, and since the lateral edge portions 64 of offset end flanges 56, 58 are joined to the inside walls of channel side walls 70, 72, a fluid tight seal is provided, so that fluid inside manifolds 26, 28 can only flow through the flow channels 54 inside plate pairs 20.

The U-shaped channels or manifolds 26, 28 are formed from folded or formed aluminum sheet or an alumninum extrusion cut to a desired length and thus have open ends 74. Top end plate 36 closes the open ends 74 at the top of manifolds 26,28 and bottom end plate 40 closes the bottom open ends 74 of manifolds 26,28. As seen best in FIGS. 2 and 8, bottom end plate 40 also has offset end flanges 76 that fit snugly inside the U-shaped channels or manifolds 26 and 28 and engage the flange extension 62 formed on the adjacent bottom plate 46. Bottom end plate 40 is actually an inverted U-shaped member having side skirts 78 with distal extensions 80 that wrap around manifolds 26, 28 to help hold heat exchanger 10 together during assembly. If desired, top end plate 36 could be the same configuration as bottom end plate 40.

It will be appreciated that U-shaped manifolds 26, 28 could have other cross-sectional configurations, such as trapezoidal, or hemispheroidal. For the purposes of this disclosure, the term "U-shaped" is intended to include any cross-sectional configuration that is capable of enclosing offset end flanges 56, 58.

Referring next to FIGS. 3 to 5, it will be seen that raised peripheral edge portions 50, 52 are formed with fingers 82 spaced from the flange lateral edge portions 64 to define slots 84 to accommodate the U-shaped channel side walls 70, 72. As seen best in FIG. 5, slots 84 are slightly tapered inwardly to urge the U-shaped channel side walls 70,72 into tight engagement with lateral edge portions 64.This provides a snug fit, so that manifolds 26, 28 actually clip on and are retained in position during the assembly of heat exchanger 10. If desired, fingers 82 could be twisted 90 degrees during assembly to help lock the manifold walls 70,72 against lateral edge portions 64. Slots 84 are slightly deeper or longer than the length of side walls 70, 72 that extend into the slots for purpose which will be described further below.

Figure 6:
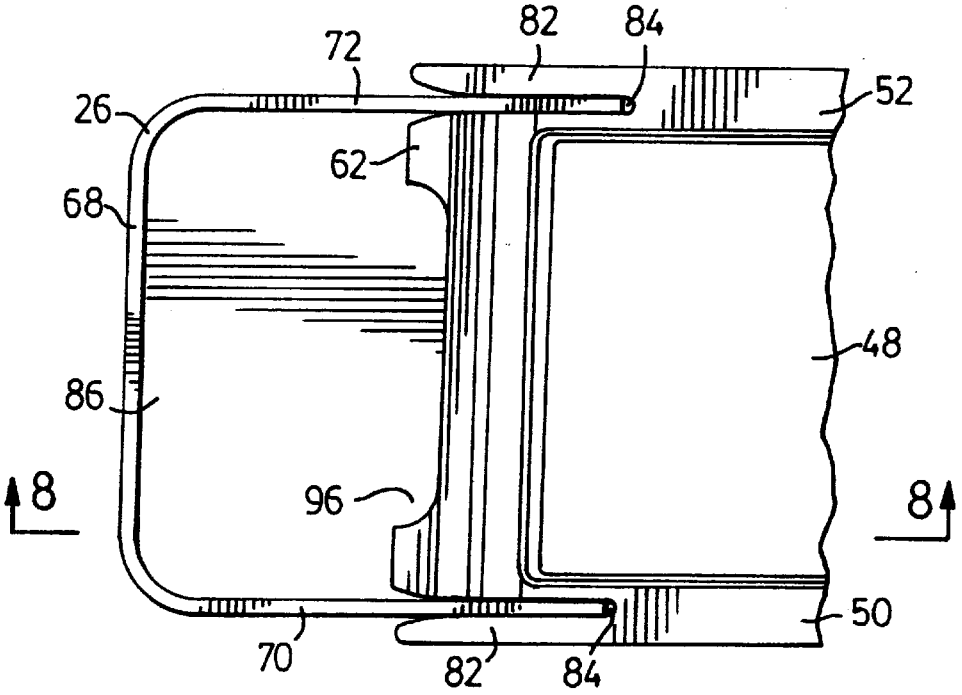
FIG. 6 is a plan view similar to FIG. 4 showing the addition of a baffle in one of the manifolds.

FIG. 6 shows the use of a baffle 86 attached to one of the flange extensions 62 and extending between the U-shaped channel rear wall 68 and side walls 70, 72 to divide manifold 26 into separate compartments above and below baffle 86. Baffle 86 would be used in a location, for example, such as is shown by chain dotted lines 88 in FIG. 1 to divide manifold 26 into a lower compartment 90 communicating with inlet fitting or opening 30, and an upper compartment 92 communicating with outlet fitting or opening 32. In this way, fluid entering inlet 30 would pass through the plate pairs 20 located below baffle 86, enter manifold 28 and flow upwardly to pass back through the plate pairs located above baffle 86 to exit through outlet 32. Baffle 86 could be located at any plate pair between inlet 30 and outlet 32 to balance the cooling inside heat exchanger 10.

FIG. 8 shows various types of baffles that could be used in heat exchanger 10. This is for illustration only, because normally there would only be one baffle used in heat exchanger 10. However, if it were desired to divide heat exchanger 10 into multiple discrete heat exchangers or zones, each having its own inlet and outlet, then any number of baffles could be used to divide up heat exchanger 10 into separate heat exchangers. Also, the baffles could be used selectively in both the manifolds 26, 28 to cause the coolant to flow in a serpentine path through the heat exchanger, if desired.

In FIG. 8, baffles 86, 93, 94 and 95 are shown having bifurcated inner ends to engage the mating flange extensions 62. These bifurcated ends 96 also help hold flange extensions 62 together during assembly of heat exchanger 10. Baffles 86, 94 and 97 also have resilient wall portions 98 to act as springs to ensure a good seal against the U-shaped channel rear wall 68, and to accommodate any movement of the heat exchanger components while they are being joined together, such as by brazing.

Figure 7:
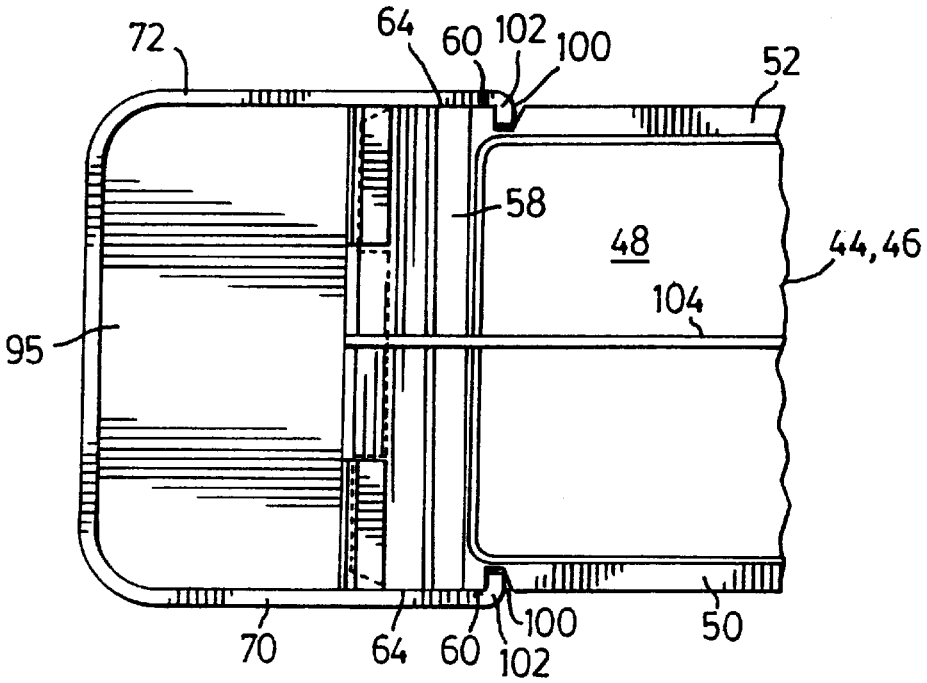
FIG. 7 is a plan view similar to FIGS. 4 and 6 but showing another preferred embodiment of the present invention.

FIG. 7 shows another preferred embodiment wherein the plate raised peripheral edge portions 50, 52 are formed with transverse notches 100 instead of slots 84 as in the embodiment of FIG. 6. Notches 100 are located inwardly of but adjacent to the lateral edge portions 64 and root areas 60 where offset end flange 58 start to diverge. Channel side walls 70, 72 are formed with inwardly disposed peripheral flanges 102 that are located in notches 100. Notches 100 are deeper than flanges 102, and side walls 70, 72 are somewhat resilient, so peripheral flanges 102 snap into notches 100 allowing the U-shaped channels to clip on to the core assembly and lock the assembly together.

Plates 44, 46 in FIG. 7 are also formed with longitudinal, inwardly disposed matching ribs 104 which strengthen the plate pairs and keep the planar central portions 48 from sagging during the brazing process to complete heat exchanger 10. If desired, longitudinal ribs 104 could also be employed in the embodiment shown in FIGS. 2 to 6. Multiple ribs 104 could be provided as well. Also, instead of ribs 104, central portions 48 could be formed with dimples (not shown) that extend inwardly in mating engagement in the plate pairs. Another possibility is to provide flow enhancing turbulizers or turbulators (also not shown) between the plates of the plate pairs 20.

Figure 9:
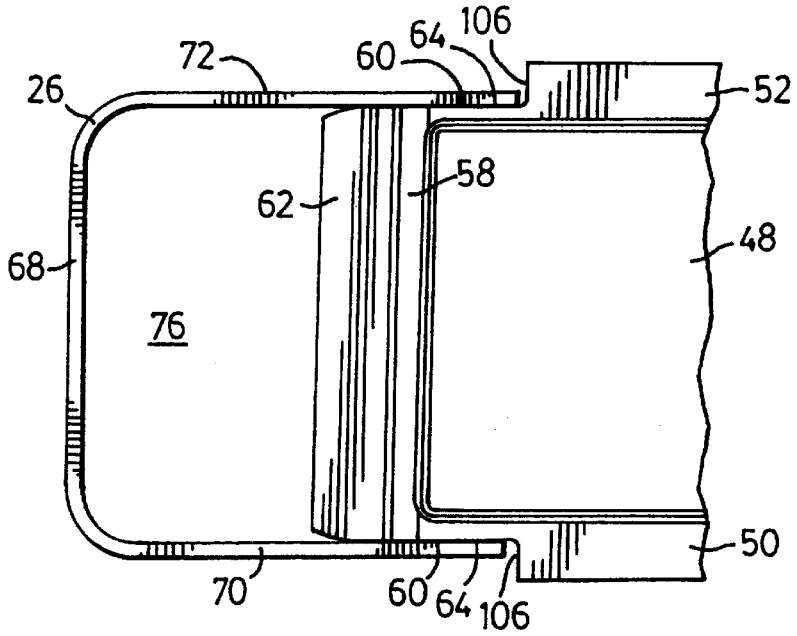
FIG. 9 is a plan view similar to FIG. 4 but showing another preferred embodiment of the invention.

Referring next to FIG. 9, another preferred embodiment of the invention is shown where peripheral edge portions 50,52 are formed with necked-in portions 106 instead of slots 84 as in the embodiment of FIG. 6. Necked-in portions 106 extend inwardly beyond lateral edge portions 64 and root areas 60 where offset end flanges 58 start to diverge, so that channel side walls 70,72 provide a sealed enclosure communicating with the flow passages between the plates of the plate pairs 20.

Figure 10:
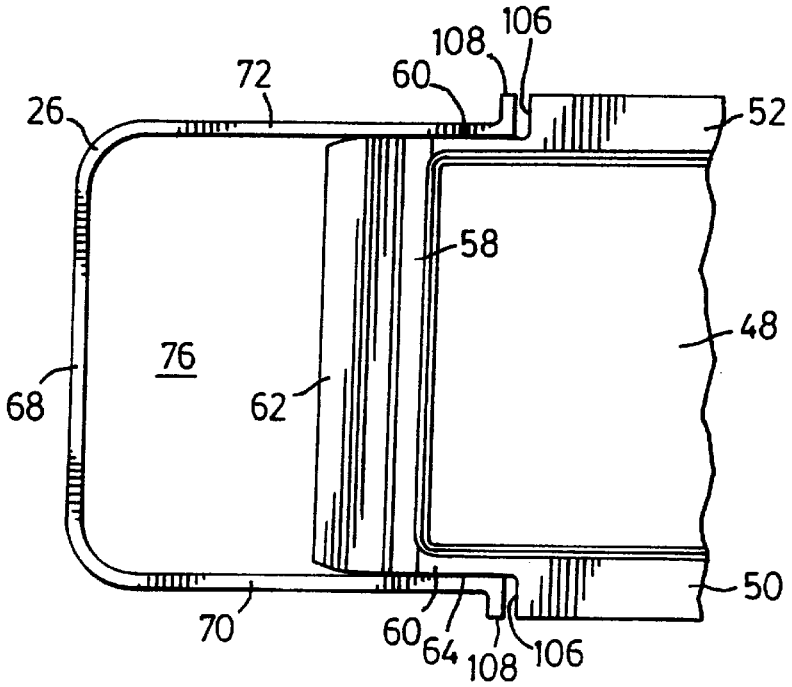
FIG. 10 is a plan view similar to FIGS. 4 and 9, but showing a modification to the embodiment of FIG. 9.

FIG. 10 is similar to FIG. 9, but shows side walls 70, 72 having outwardly disposed peripheral flanges 108. Flanges 108 provide a surface upon which a fixture can press to urge manifolds inwardly to hold the components of heat exchanger 10 together during the assembly and brazing process.

In the embodiments shown in FIGS. 9 and 10, manifolds 26, 28 are still considered to "clip on" for the purposes of the present invention, since the manifold side walls 70, 72 would be somewhat resilient and would frictionally engage lateral edge portions 64 to hold the manifolds in place, at least during the initial assembly of the components of the heat exchangers of the invention.

Figure 11:
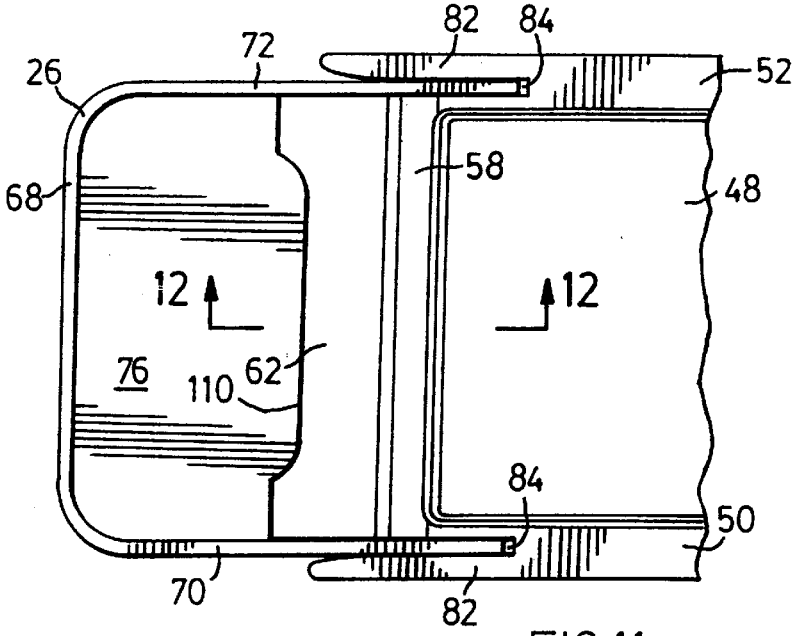
FIG. 11 is a plan view similar to FIG. 4, but showing a modification to the flange extensions.
Figure 12:
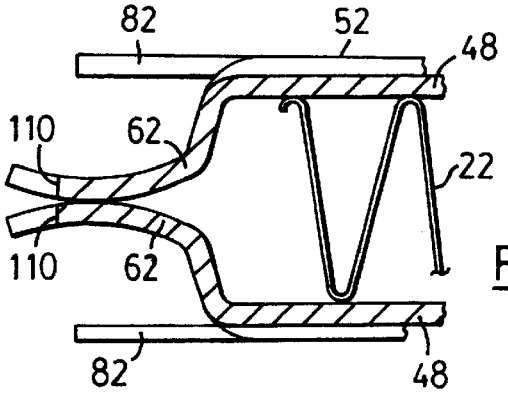
FIG. 12 is a vertical sectional view taken along lines 12—12 of FIG. 11.

FIGS. 11 and 12 show a further modification. which is applicable to any of the embodiments described above. In the FIGS. 11 and 12 embodiment, the transverse distal edge portions or flange extensions 62 are formed with cut-outs or notches 110. Flange extensions 62 can be made with different widths to adjust the low through manifolds 26, 28 and notches 110 can be used to further refine or fine tune the flow patterns inside the manifolds. As seen best in FIG. 12, flange extensions 62 are curved to ensure a good seal therebetween, in case the notches 110 do not line up perfectly in the assembly of heat exchanger 10.

Figure 13:
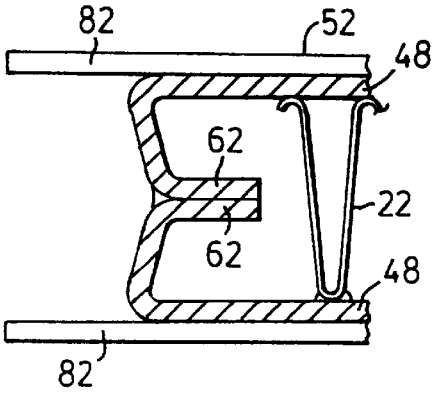
FIG. 13 is a vertical sectional view similar to FIG. 12 but showing a modified form of flange extension.

FIG. 13 is a view similar to FIG. 12, but it shows a further modification of flange extensions 62 in that they extend inwardly instead of outwardly as in the previous embodiments. Again, this configuration could be used in any of the embodiments described above. The inwardly directed flanges 62 give the maximum unobstructed flow through manifolds 26, 28.

Figure 2:
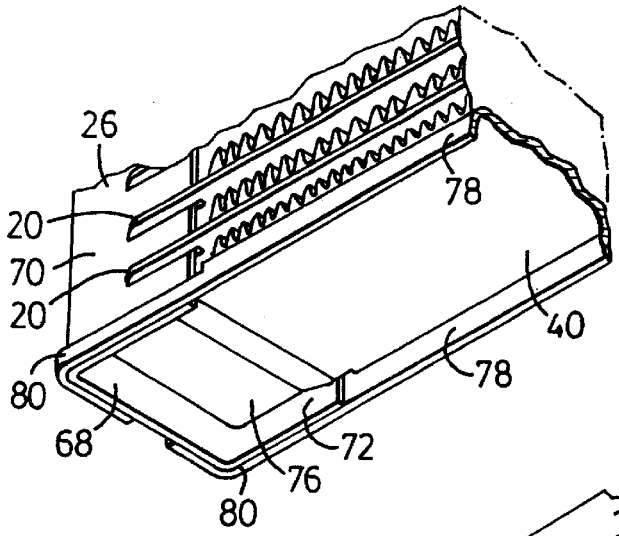
FIG. 2 is a bottom left perspective view of the lower corner of the heat exchanger shown in FIG. 1 as viewed in the direction of arrow 2.
Figure 14:
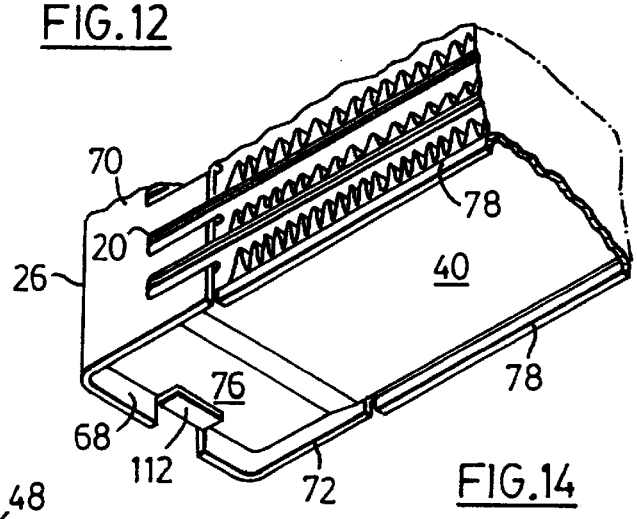
FIG. 14 is a bottom left perspective view of similar to FIG. 2 but showing a modification for locking the plate pairs together.

FIG. 14 is a view similar to FIG. 2, but it shows a modification to end plate 40 where distal extensions 80 have been eliminated. Instead of distal extensions 80 to help hold the heat exchanger components together during the assembly process, manifold rear walls 68 are formed with tabs 112 that are bent over to engage offset end flanges 76 of end plate 40. Tabs 112 help hold the stack of plate pairs 20 together while the heat exchanger is being set up for brazing. If desired, however, both tabs 112 and the distal extensions 80 of the FIG. 2 embodiment could be used together in the same heat exchanger.

Figure 15:
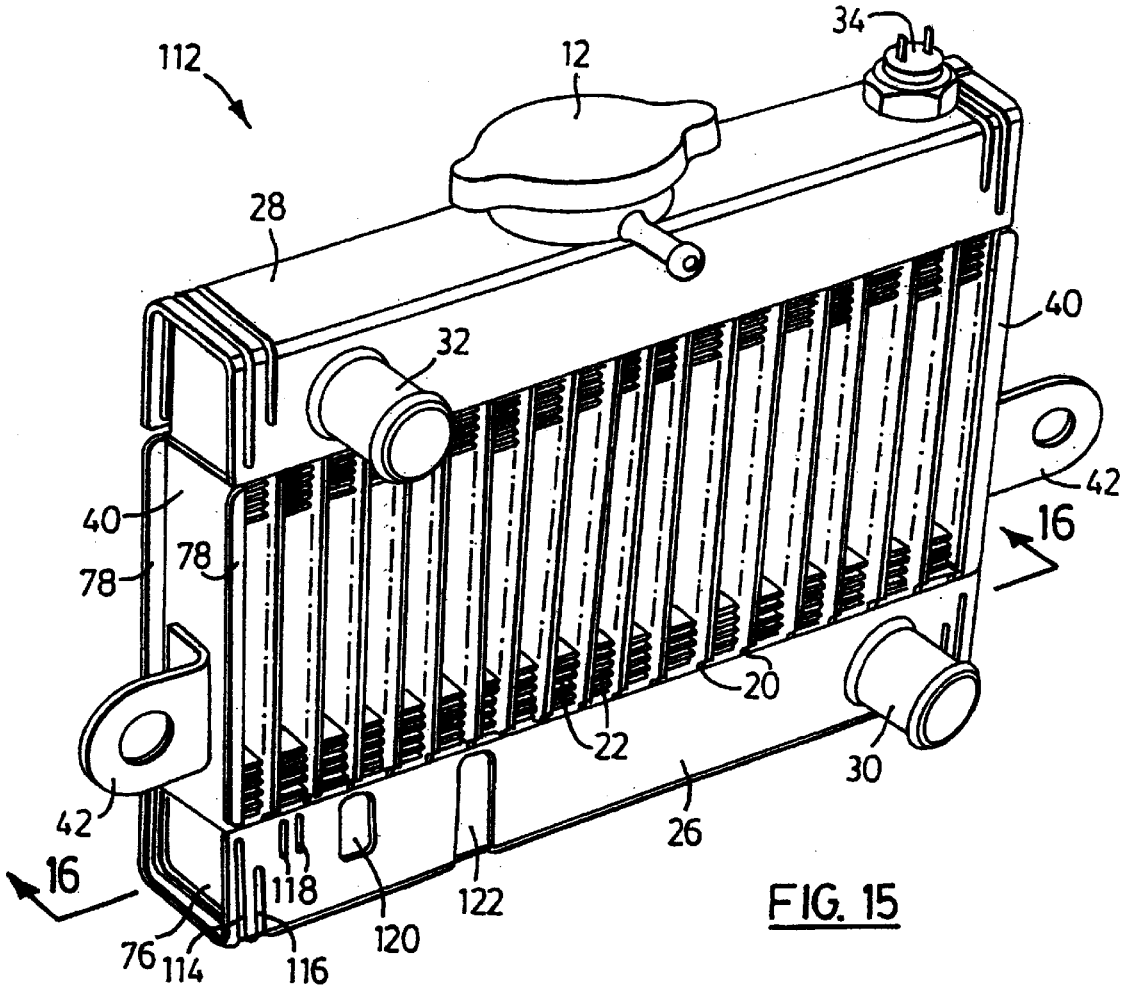
FIG. 15 is a top, left perspective view of another preferred embodiment of a heat exchanger made in accordance with the present invention.
Figure 16:
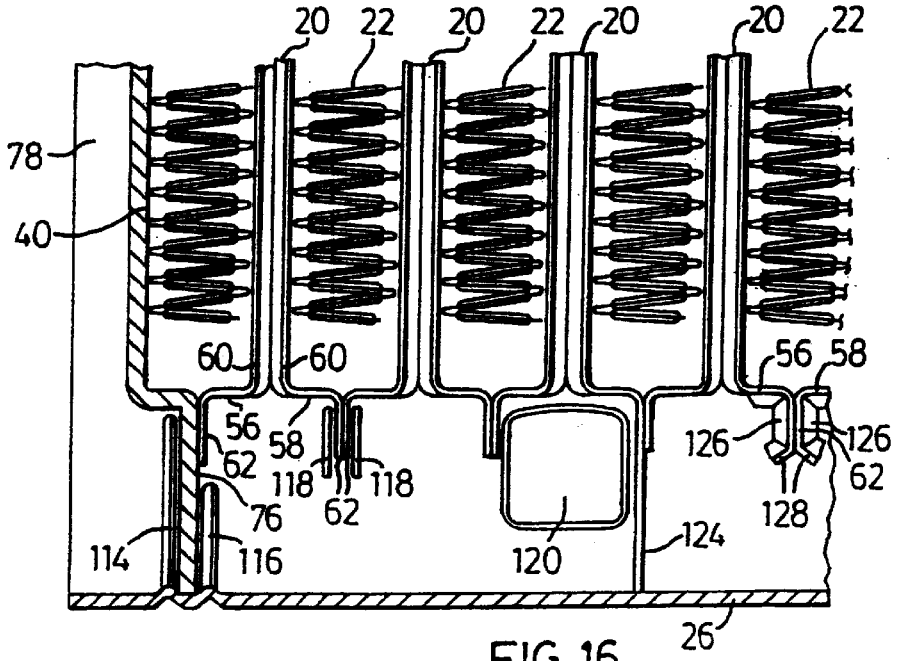
FIG. 16 is an enlarged vertical sectional view taken along lines 16—16 of FIG. 15 showing the lower left corner of the heat exchanger of FIG. 15.

Referring next to FIGS. 15 and 16, another preferred embodiment of a heat exchanger 112 is shown, which has top and bottom manifolds 28 and 26 instead of side mounted manifolds as in FIG. 1. In heat exchanger 112, the U-shaped channels or manifolds 26,28 are formed with parallel, U-shaped, inwardly disposed ribs 114,116 adjacent to their ends to accommodate and act as locating guides for the offset end flanges 76 of end plates 40. It will be noted that rib 116 is shorter than rib 114 to accommodate the adjacent plate flange extension 62. The ribs engage and locate the end plates to ensure that good brazing joints are achieved between end plate offset end flanges 76 and manifolds 26,28.

FIGS. 15 and 16 also show some additional optional guide and braze enhancing means for the plate flange extensions 62. One option is to use parallel, inwardly disposed, closely spaced-apart, short ribs 118 to sandwich therebetween the peripheral edges of flange extensions 62. Another option is to use inwardly disposed bosses 120 that appear as dimples from the outside of manifolds 26,28. The bosses could be U-shaped as indicated by U-shaped dimples 122 in FIG. 15 (not shown in FIG. 16). These U-shaped bosses or dimples 122 would be particularly useful where a baffle is employed in manifolds 26,28.

FIG. 16 also shows a couple of other modifications to be preferred embodiments, such as an extended distal flange extension 124 on one of the plates of a plate pair 20. Extended flange extension 124 extends filly between the U-shaped channel or manifold rear and side walls to form a baffle inside manifolds 26,28.

FIG. 16 also shows that lateral or side flanges 126 could be provided on the plate offset end flanges 56,58 to help ensure good brazing joints between end flanges 56,58 and the adjacent walls of the manifolds 26,28. Also shown are transverse, distal, offset flanges 128 that could be added to flange extensions 62 to keep flange extensions 62 straight during the brazing process and help provide good bonds therebetween.

Figure 17:
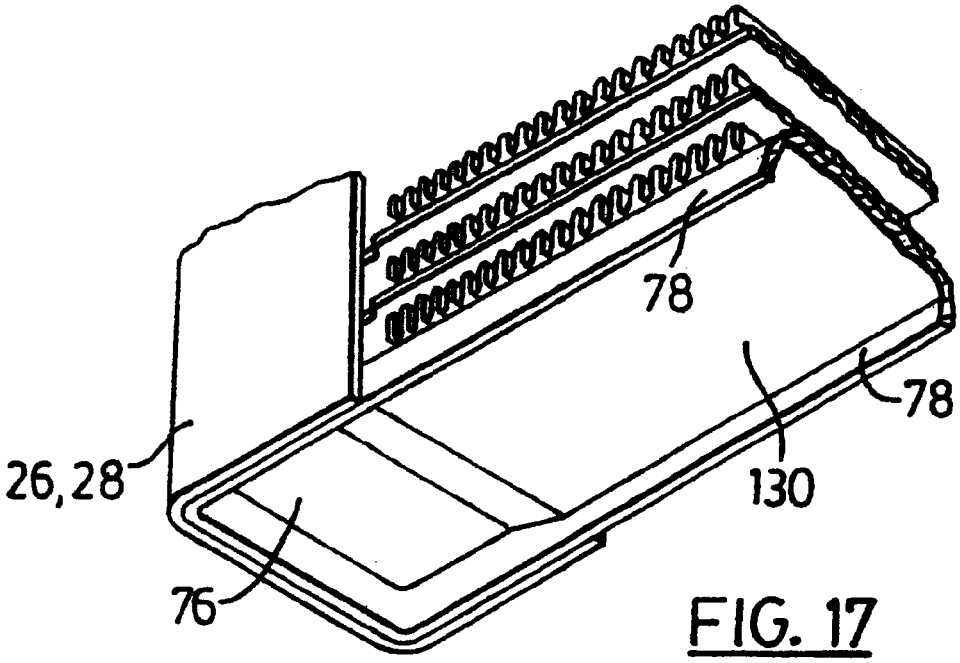
FIG. 17 is a bottom left perspective view similar to FIG. 2 but showing another preferred embodiment of an end bracket.

Referring next to FIG. 17, a modification to the end plates is shown where end plate 130 side skirts 78 extend integrally around offset end flange 76 to form a pan type end portion that engages the bottom walls of the manifolds 26,28.

In a typical application, the components of heat exchanger 10 are made of brazing clad aluminum (except for the peripheral components such as fittings 30,32, filler cap and fitting 12, 14 and mounting brackets 38, 42). The brazing clad aluminum for core plates 44, 46 typically have a metal thickness between 0.3 and 1 mm (0.012 and 0.040 inches). End plates 36 and 40 have a thickness between 0.6 and 3 mm (0.024 and 0.120 inches), and baffles 86, 93, 94, 95 and 97 have a thickness between 0.25 and 3 mm (0.010 and 0.120 inches). However, it will be appreciated that materials other than aluminum can be used for the heat exchangers of the present invention, even plastic for some of the components, if desired.

The preferred method of making heat exchanger 10 is to roll form an elongate strip of plate material having planar central portion 48 and raised peripheral edge portions 50, 52. Preferably, the plates are formed of brazing clad aluminum. The plate material is then cut into predetermined lengths to determine the desired width of heat exchanger 10. The ends of the plates are then formed, such as by stamping, to create offset end flanges 58 and either slots 84, notches 100 or necked-in portions 106. The plates are then arranged into plate pairs with the offset end flanges 58 diverging or extending in a direction away from peripheral edge portions 50, 52. The peripheral edge portions 50, 52 are thus engaged or in contact. The plate pairs are then stacked together in any desired number. Cooling fins 22 are located between the plate pairs during the stacking process. U-shaped channels 26, 28 are then cut to length to match the height of the stacked plate pairs. Any desired baffles are attached to the plate pairs at selected locations, and the U-shaped channels are then pressed, slid or clipped onto the ends of the stacked plate pairs enclosing the offset end flanges 58. Top and bottom end plates 36, 40 are then located to close the open ends of the U-shaped channels. Any other fittings or attachments, such as inlet and outlet fittings 30, 32, filler cap fitting 14 or brackets 38, 42 can be located on the assembly, and the entire assembly is then placed into a brazing furnace to braze the components together and complete the heat exchanger.

Having described preferred embodiments of the invention, it will be appreciated that various modifications may be made to the structures described above. For example, turbulizers could be used between the plate pairs if desired. The plates could be dimpled in the area of planar central portions 48, as is common in dimpled plate heat exchanges. Other types of cooling fins could be used, or no fins at all. The heat exchangers could be made of other materials than brazing clad aluminum such as plastic. Also, the manifolds could have other shapes, if desired.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A heat exchanger comprising:

a plurality of stacked plate pairs formed of mating plates having central planar portions and raised peripheral edge portions, said edge portions being joined together in mating plates to define a flow channel between the plates; the plates having offset end flanges, the respective flanges at each end of each plate pair diverging, the flanges having lateral edge portions extending from root areas located at the joined peripheral edge portions, the end flanges also having transverse distal edge portions joined together in back-to-back stacked plate pairs to space the plate pairs apart and form transverse flow passages between the plate pairs; opposed U-shaped channels enclosing the respective end flanges of the plate pairs, the channels having rear walls spaced from the plate end flanges and side walls joined to the flange lateral edge portions and extending inwardly beyond and covering said root areas, the U-shaped channels having open ends; end plates closing the U-shaped channel open ends to form manifolds; and the manifolds defining inlet and outlet openings therein for the flow of fluid through the plate pairs.

2. A heat exchanger as claimed in claim 1 wherein the plate end flange transverse distal edge portions are in the form of flange extensions extending generally parallel to the plate central planar portions.

3. A heat exchanger as claimed in claim 1 wherein the plate raised peripheral edge portions are formed with transverse notches located between but adjacent to said root areas, and wherein the U-shaped channel side walls have inwardly disposed peripheral flanges adapted to snap into said notches.

4. A heat exchanger as claimed in claim 3 wherein said notches have a depth greater than the width of the U-shaped channel side wall peripheral flanges.

5. A heat exchanger as claimed in claim 2 and further comprising a baffle attached to one of said flange extensions and extending between the U-shaped channel rear and side walls to divide the manifold into a plurality of compartments.

6. A heat exchanger as claimed in claim 2 and further comprising heat transfer fins located between the plate pairs and in contact with the plate planar central portions.

7. A heat exchanger as claimed in claim 3 and further comprising heat transfer fins located between the plate pairs and in contact with the plate planar central portions.

8. A heat exchanger as claimed in claim 2 wherein said transverse distal edge portions are formed with notches therein to adjust the flow distribution through the U-shaped channels.

9. A heat exchanger according to claim 1, wherein the end plates are formed with offset end flanges.

10. A heat exchanger according to claim 9, wherein the U-shaped channels are formed with parallel, U-shaped, inwardly disposed ribs adjacent to their ends to accommodate and act as locating guides for the offset end flanges of the end plates.

11. A heat exchanger according to claim 2, wherein the U-shaped channels are formed with parallel, inwardly disposed, closely spaced-apart, short ribs sandwiching therebetween the peripheral edges of the flange extensions.

12. A heat exchanger according to claim 1, further comprising an extended distal flange extension on one of the plates of a plate pair, said extended distal flange extension extending fully between the U-shaped channel rear and side walls to form a baffle.

13. A heat exchanger according to claim 12, wherein the U-shaped channel is formed with an inwardly disposed boss abutting and connected to said baffle.

14. A heat exchanger according to claim 5, wherein the U-shaped channel is formed with an inwardly disposed boss abutting and connected to said baffle.

15. A heat exchanger according to claim 9, further comprising end plate side skirts extending integrally around each offset end flange to form a pan that engages a respective one of the U-shaped channels.

16. A method of making a heat exchanger comprising the steps of:

providing an elongate strip of plate material having a planar central portion and raised peripheral edge portions; cutting the plate material into predetermined lengths; forming the plate lengths with offset end flanges extending in a direction away from the raised peripheral edge portions; arranging the plate lengths into plate pairs with the offset end flanges diverging and the plate peripheral edge portions in contact so as to define root areas at the joined peripheral edge portions; stacking said plate pairs so that the end flanges engage to space the plate pairs apart; providing U-shaped channels enclosing the plate offset end flanges, the channels having open ends and side walls joined to the flange lateral edge portions and extending inwardly beyond and covering the root areas; closing the open ends of the channels to form manifolds; forming inlet and outlet openings in the manifolds; and joining the plates and manifolds together to form a sealed heat exchanger.

17. A method of making a heat exchanger as claimed in claim 16 wherein the plates are arranged in a predetermined number of plate pairs having a predetermined height, wherein the U-shaped channels are provided in lengths at least as long as said predetermined height, and wherein the channel open ends are closed by providing end plates on each end of the stacked plate pairs extending between and closing the channel open ends.

18. A method of making a heat exchanger as claimed in claim 16 and further comprising the steps of providing a plurality of cooling fins and inserting said cooling fins respectively between the plate pairs.

19. A method of making a heat exchanger as claimed in claim 17 and further comprising the steps of providing a plurality of cooling fins and inserting said cooling fins respectively between the plate pairs.

20. A method of making a heat exchanger as claimed in claim 16 and further comprising the step of dividing the heat exchanger into zones by providing baffles in the U-shaped channels engaging the offset end flanges.

21. A method of making a heat exchanger as claimed in claim 17 and further comprising the step of dividing the heat exchanger into zones by providing baffles in the U-shaped channels engaging the offset end flanges.

22. A method of making a heat exchanger as claimed in claim 18 and further comprising the step of dividing the heat exchanger into zones by providing baffles in the U-shaped channels engaging the offset end flanges.

* * * * *

UNITED STATES PATENT AND TRADEMARK OFFICE

CERTIFICATE OF CORRECTION

PATENT NO. : 6,332,495 B1
DATED : December 25, 2002
INVENTOR(S) : Jamison et al.

It is certified that error appears in the above-identified patent and that said Letters Patent is hereby corrected as shown below:

Column 10,
Line 11, insert -- 23. A heat exchanger as claimed in claim 7 wherein said baffle has a resilient wall portion. --

Signed and Sealed this

Twenty-eighth Day of May, 2002

*Attest:*

*Attesting Officer*

JAMES E. ROGAN
*Director of the United States Patent and Trademark Office*